US006189598B1

(12) United States Patent
Chandley et al.

(10) Patent No.: US 6,189,598 B1
(45) Date of Patent: Feb. 20, 2001

(54) LOST FOAM CASTING WITHOUT FOLD DEFECTS

(75) Inventors: George D. Chandley, Amherst; Qi Zhao, Nashua, both of NH (US)

(73) Assignee: General Motors Corporation, Detroit, MI (US)

( * ) Notice: Under 35 U.S.C. 154(b), the term of this patent shall be extended for 0 days.

(21) Appl. No.: 09/166,788

(22) Filed: Oct. 5, 1998

(51) Int. Cl.[7] ..... B22C 9/04; B22C 7/02

(52) U.S. Cl. ..... 164/34; 164/45; 164/235; 164/516

(58) Field of Search ..... 164/34, 45, 137, 164/235, 516, 517, 518, 519, 361

(56) References Cited

U.S. PATENT DOCUMENTS

| | | | |
|---|---|---|---|
| 3,675,708 | 7/1972 | Blazek | 164/35 |
| 3,946,039 | 3/1976 | Walz | 264/332 |
| 4,010,791 | 3/1977 | Hetke et al. | 164/34 |
| 4,085,790 | 4/1978 | Wittmoser | 164/7 |
| 4,448,235 | 5/1984 | Bishop | 164/34 |
| 4,482,000 | 11/1984 | Reuter | 164/34 |
| 4,616,689 | 10/1986 | Denis | 164/34 |
| 4,812,278 | 3/1989 | Natori et al. | 264/221 |
| 4,874,029 | 10/1989 | Chandley | 164/34 |
| 5,355,931 | 10/1994 | Donahue et al. | 164/34 |
| 5,385,698 | 1/1995 | Bishop et al. | 264/53 |
| 5,391,341 | 2/1995 | Ballewski et al. | 264/113 |
| 5,630,461 | 5/1997 | CoChimin | 164/34 |
| 5,983,982 * | 11/1999 | Vintelie et al. | 164/34 |
| 6,006,818 * | 12/1999 | Berthelet et al. | 164/34 |

* cited by examiner

*Primary Examiner*—Harold Pyon
*Assistant Examiner*—I.-H. Lin

(57) ABSTRACT

Fold defects are reduced or eliminated in lost foam castings by contacting a destructible polymeric pattern surface proximate to which deleterious fold defects comprising unbonded seams are prone to form in the solidifying molten metal with a material that reduces or eliminates fold defects in the casting proximate the pattern surface. The material can comprise a silicone layer that is anti-sticking relative to a gas permeable refractory layer on the pattern or foundry sand directly contacting the pattern surface depending on casting configuration. The pattern is cleaned prior to contact with the material. Lower melt casting temperatures can be used with concomitant improvements in casting microstructure (e.g. finer dendritic arm spacing) and mechanical properties.

7 Claims, 8 Drawing Sheets

-NO TREATMENT

-ONE FOLD OF 1/4"X1/4" FROM TOP SURFACE(AS SEEN) DOWN WITHIN THE CONTROLLED AREA

-SOAP WATER CLEANED

-NO FOLDS

-SOAP WATER CLEANED

-SILICONE SPRAYED

-NO FOLDS

-ULTRASONICALLY CLEANED

-NO COATING (WASH OFF)

-NO FOLDS

LOST FOAM CASTING WITHOUT FOLD DEFECTS

FIELD OF THE INVENTION

The present invention relates to lost foam casting and, more particularly, to method and apparatus for lost foam casting of metals and alloys, especially aluminum and its alloys, with substantially reduced fold defects.

BACKGROUND OF THE INVENTION

Lost foam casting of metals and alloys involves pouring molten metal or alloy onto a vaporizable polystyrene pattern residing in a bed of foundry sand so that the molten metal vaporizes the pattern and displaces it in the foundry sand to form a casting. Lost foam casting is described in such patents as U.S. Pat. Nos. 4,085,790; 4,616,689; and 4,874,029. In the past, the polystyrene pattern has been coated with an thermally insulative, gas permeable refractory layer or coating prior to being embedded in the foundry sand. The gas permeable refractory coating allows pattern decomposition vapors to vent into the foundry sand and also helps prevent collapse of the sand as the pattern is vaporized. U.S. Pat. Nos. 4,482,000 and 4,448,235 describe polymer-modified refractory coatings for use on polystyrene lost foam patterns to reduce entrapment of pattern decomposition vapors in the molten metal as it replaces the pattern.

In the lost foam casting of aluminum alloys using polystyrene patterns having core-forming passages that are filled with foundry sand when the pattern is embedded in the foundry sand bed, the gaseous decomposition products of the foam pattern have been found to cause gas holes and so-called fold defects in the cast component proximate the core-forming passages, especially those passages located remote from the initial melt/pattern contact region. The gas holes are usually rounded and detectable upon x-ray examination of the cast component and affect casting quality in dependence on their size and quantity. Fold defects generally are not detectable on x-ray examination but are found when castings are test fractured. Fold defects generally are considered nearly two dimensional, constituting very thin void regions or seams of unbonded metal forming a plane of weakness that results in low strength and low ductility of the casting. In the past, attempts to reduce fold defects in lost foam aluminum alloy castings have involved casting the molten aluminum alloy at very high temperatures of up to 1450 degrees F, for example. However, although fold defects may be reduced by use of high melt casting temperatures, they nevertheless still have been found to be present in a problematic percentage (e.g. 10–50%) of lost foam castings that are produced in a high volume lost foam production environment such as, for example, cast automotive cylinder blocks and heads. Moreover, use of such high melt casting temperatures produces coarse grained lost foam castings that reduces their mechanical properties.

Production engineers have been constantly attempting to eliminate or substantially reduce fold defects in lost foam castings but, to-date, there has been no generally reliable solution to the problem of fold defects. As a result, lost foam cast components of less than optimum quality and higher than desired lost foam production costs still are encountered.

An object of the present invention is to provide method and apparatus for lost foam casting of aluminum and its alloys as well as other metals and alloys using a vaporizable pattern in a manner to substantially reduce or eliminate fold defects in the cast component.

SUMMARY OF THE INVENTION

The present invention provides a method of lost foam casting wherein thin, elongated void regions or seams of unbonded metal (i.e. fold defects) in the casting are reduced or eliminated. The present invention involves selectively contacting one or more surfaces of a destructible pattern proximate to which one or more fold defects are prone to form in the casting with a material that is effective to reduce or eliminate fold defects in the casting proximate the surface (s).

One illustrative embodiment of the present invention involves selectively contacting the pattern surface with a material, such as for example only, silicone, that is anti-sticking relative to the usual gas permeable refractory layer that is subsequently applied on the pattern so that the refractory layer does not tightly adhere or stick to the pattern surface as the pattern is destroyed during casting. The material allows the pattern to shrink away from the refractory layer at the selectively coated area and decompose without accumulation of pattern decomposition material (e.g. coalesced polymer decomposition liquids) at the refractory layer proximate the pattern surface that can generate fold defects in the casting. In a particular embodiment of the present invention, the material can comprise a layer of silicone or other material that reduces adherence or sticking of the refractory layer to the pattern surface proximate to which fold defects form in the casting.

In another illustrative embodiment of the present invention, the pattern can be coated with the usual gas permeable refractory layer with, however, the pattern surface proximate to which fold defects are prone to be formed in the casting left uncoated for direct contact with the refractory mass (e.g. foundry sand) when the pattern is positioned therein. The refractory mass directly contacting the uncoated pattern surface avoids harmful accumulation of pattern decomposition material proximate the pattern surface that can generate fold defects in the casting.

In practicing embodiments of the present invention, the entire destructible pattern preferably is cleaned with a cleaning agent prior to being contacted with the anti-sticking material or the refractory mass in the manner described above.

The present invention substantially reduces or eliminates fold defects in lost foam aluminum alloy and other metal/alloy castings and, if desired, permits lower melt casting temperatures to be used with concomitant improvements in casting microstructure (e.g. finer dendritic arm spacing) and mechanical properties.

Advantages and objects of the present invention will be better understood from the following detailed description of the invention taken with the following drawings.

DESCRIPTION OF THE INVENTION

The present invention provides method and apparatus for lost foam casting of aluminum and its alloys and other metals and alloys prone to development of fold defects proximate one or more surface features of a destructible pattern. Representative fold defects FF in an aluminum alloy 319 lost foam casting are shown for purposes of illustration in FIGS. 1 and 2. The fold defects FF are nearly two dimensional, comprising a very thin, elongated void region or seam of unbonded metal that forms a plane of weakness in the casting and that causes low strength and low ductility of the casting.

Although the present invention will be described in detail herebelow with respect to lost foam casting of aluminum alloys highly prone to fold defects, the invention is not so limited can be practiced to substantially reduce or eliminate fold defects in the lost foam casting of other metals and alloys, such as magnesium and its alloys and others, that may be prone to development of fold defects.

Although polystyrene foam destructible patterns are described in detail below, various other polymeric and other patterns destructible by the molten metal being cast may be used in practicing the invention. For example only, in addition to polystyrene foam patterns, polymeric patterns comprising polymethylmethacrylate and other foam thermoplastic resinous materials can be used in practicing the invention and are described in U.S. Pat. No. 5,385,698, the teachings of which are incorporated herein by reference.

Figure 3A:
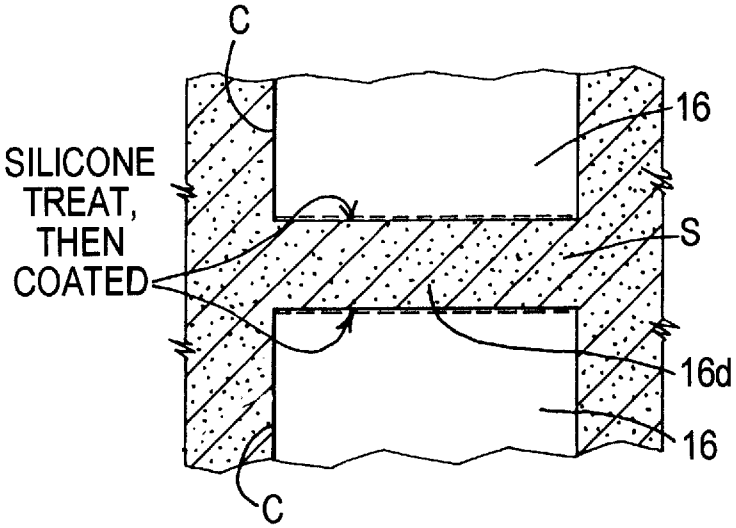
FIG. 3A is an enlarged elevational view of a core-forming passage.
Figure 3:
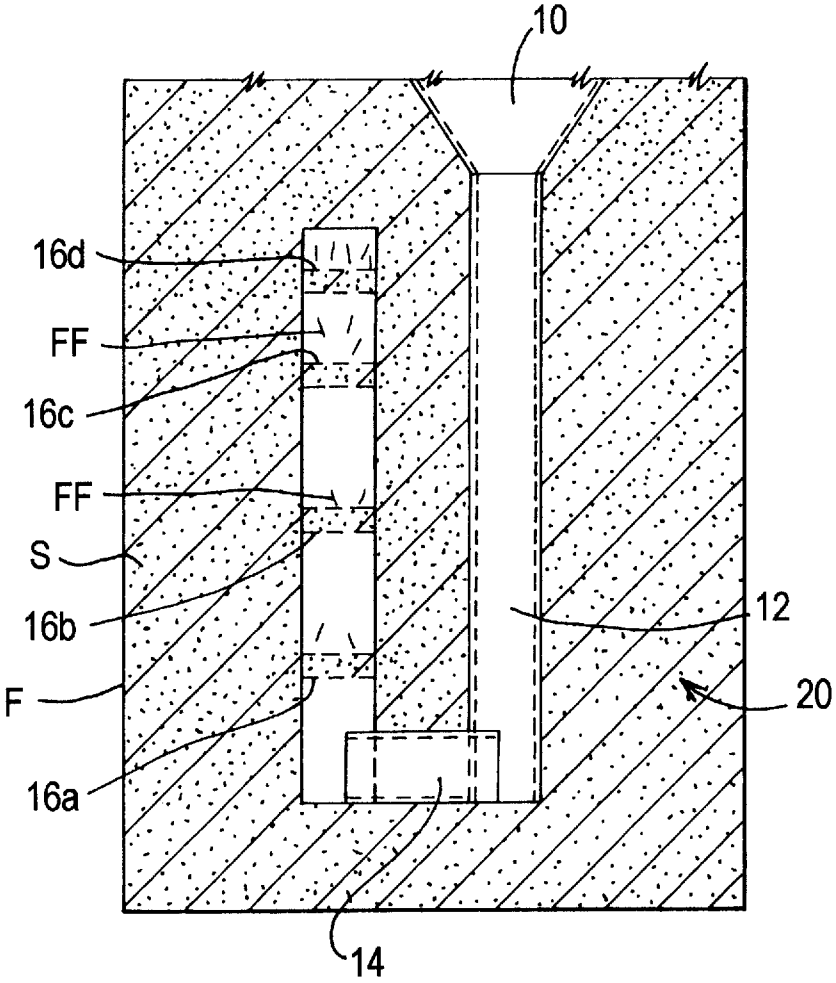
FIG. 3 is a schematic view of a lost foam casting test apparatus including a polystyrene pattern having multiple internal refractory coated transverse core-forming passages therein embedded in a bed of foundry sand to form a cast bar.

Referring to FIG. 3, one embodiment for practicing the present invention will now be described with respect to the test apparatus shown and the test results described below. The test apparatus in FIG. 3 includes a hollow vaporizable expanded polystyrene pour cup 10 having a maximum diameter of about 3 inches at the top and terminating in a minimum diameter of 1.5 inches at the cylindrical hollow polystyrene gating or down sprue tube 12, which has an overall vertical length below the pour cup of 13 inches. The wall thicknesses of the pour cup 10 and down sprue tube 12 are ¼ inch and ⅛ inch, respectively. The down sprue tube 12 is communicated to a horizontal polystyrene side sprue tube 14 having similar inner diameter and wall thickness as the down sprue tube 12. The side sprue tube 14 is connected to a solid cylindrical polystyrene bar or rod pattern 16 (corresponding to the casting shape to be made) having a vertical length of 12 inches and diameter of 1.5 inches. For purposes of illustration, the polystyrene bar or rod pattern 16 is molded to include four cross or transverse core-forming internal passages 16*a*, 16*b*, 16*c*, 16*d*. One core-forming passage 16*d* is shown in detail in FIG. 3A. The passages 16*a*, 16*b*, 16*c*, 16*d* all have a diameter of 0.5 inch and a length corresponding to the diameter of the pattern 16. The passages 16*a*, 16*b*, 16*c*, 16*d* were positioned spaced apart at various axial distances relative to the bottom of the polystyrene bar or rod pattern 16, such as 3, 6, 9, and 11 inches above the bottom of the pattern 16. The pour cup 10, down sprue tube 12, side sprue tube 14, and pattern 16 are formed individually by foam molding and cutting and joined together by hot melt adhesive to form a pattern assembly.

When the pattern 16 is disposed in the usual dry, unbonded (loose) foundry sand bed or mass 20 as illustrated in FIG. 3, all surfaces including the refractory coated internal pattern features (e.g. passages 16*a*, 16*b*, 16*c*, 16*d*) will be filled and contacted with dry, loose backup foundry sand as shown, for example, in FIG. 3A for passage 16*d*. Although the pattern 16 is shown in FIGS. 3 and 3A for purposes of illustration having multiple (four) internal core-forming passages, the pattern 16 may include other types of internal surface features such as inwardly extending pattern recesses and changes in pattern cross-section where fold defects may be prone to develop.

In a casting trial representative of previous lost foam casting techniques, the pattern assembly surfaces invested in the sand mass are coated with a commercially available thermally insulative, gas permeable refractory layer or coating C available as Styro Kote 145.3 from Borden Chemical Company, Westchester, Ill. This refractory coating comprises silica refractory material and water.

The refractory coating C is applied as a slurry to the pattern assembly surfaces by dipping the pattern 16 in the slurry, draining excess slurry, and then drying the slurry coating about 24 hours under ambient atmosphere conditions. The thickness of the dried refractory coating typically is approximately 0.012 inch. Both the exterior pattern surfaces as well as the internal surfaces of passages 16*a*, 16*b*, 16*c*, 16*d* were coated with the refractory coating.

The refractory coated pattern 16 and connected pour cup 10 and sprue tubes 12, 14 as a unit then is embedded in dry, loose foundry sand S (e.g. AFS 55 foundry sand) held in a conventional foundry flask F with the pour cup 10 open above the sand to ambient air. The foundry sand fills the refractory coated core-forming passages 16*a*, 16*b*, 16*c*, 16*d* of the pattern 16. Aluminum alloy 319 having a nominal composition, in weight %, 6.35% Si, 3.5% Cu, and balance Al, is air melted in a conventional clay graphite refractory crucible (not shown) and dipped out of the crucible using a ladle at a melt temperature of 1200 degrees F. so that a melt pour temperature of about 1150 degrees F. is provided. About 5 pounds of the aluminum alloy 319 are poured into the pour cup 10 and gravity pushed or fed upwardly into the polystyrene bar or rod pattern 16 to progressively vaporize and displace the polystyrene pattern 16 in the bed of foundry sand 20 to produce a cast aluminum alloy bar or rod having a diameter of 1.5 inches with the four cross cores therein. The charge of molten aluminum alloy charge typically is solidified in the foundry sand over a time period of ½ hour in air.

A cast aluminum alloy 319 rod produced in this manner representative of prior lost foam casting techniques was examined using x-ray procedures (e.g. 270V and 10 milliamperes for 60 seconds) and using fracture examination procedures to determine fold counts present in the cast bar. The fracture procedure involved cutting sixteen transverse slices of the cast bar at intervals of 0.75 inch and then breaking each slice into four pieces using a vise. The fracture surfaces from the slices were examined visually and/or under microscope to determine if fold defects were present.

Table I below sets forth the results of the x-ray count and total fold length in millimeters (mm) for the cast bar designated by "lost foam" in the left hand column as representative of the prior lost foam casting techniques. A count of one in the x-ray examination was defined as a 1/16 inch diameter gas hole defect.

TABLE I

| CORE TYPE | X-RAY COUNT | FOLD LENGTH(MM) |
|---|---|---|
| LOST FOAM | 12 | 76 |
| LOST FOAM,CORES | 0 | 0 |
| SILICONE TREATED | 1 | 0 |
| | 0 | 0 |
| PEPSET | 0 | 0 |
| | 2 | 0 |
| | 0 | 0 |

Figure 2:
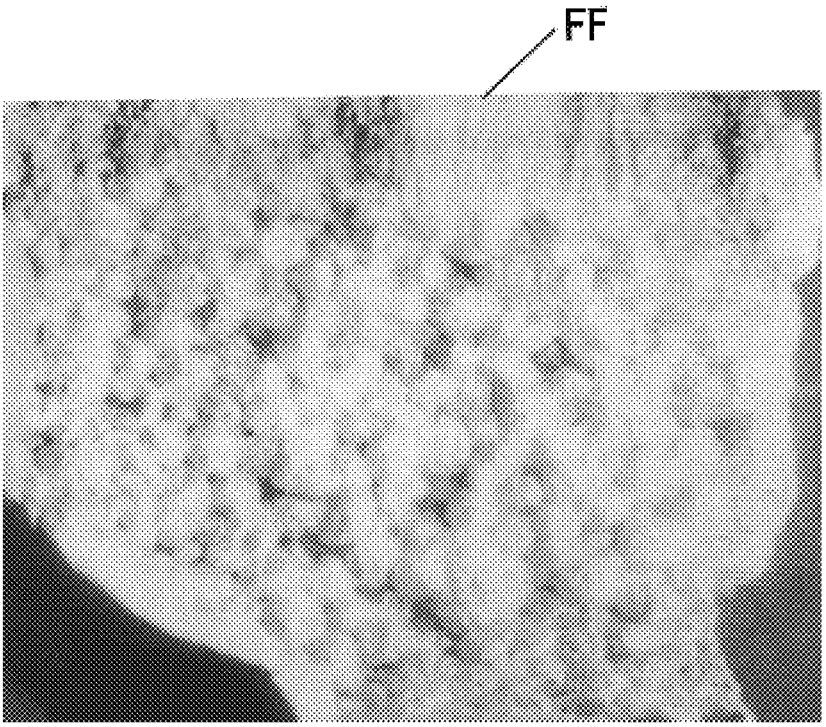
FIG. 2 is a similar photograph taken transverse to the core of a fracture surface of an aluminum alloy 319 lost foam cast rod made using the test apparatus of FIG. 3 illustrating a fold defect at the fracture surface above (orientation as-cast) the refractory coated pattern core-forming passage.

TABLE I reveals 12 x-ray counts and an aggregate fold defect length of 76 millimeters for the cast rod produced as described above. The 12 x-ray counts represent the gas hole defects detected. FIG. 2 illustrates a representative fold defect found in the aluminum alloy 319 cast rod of TABLE I above a pattern core-forming passage. The fold defect comprises a very thin void region or seam of unbonded metal that forms a plane of weakness in the casting proximate and/or above the core-forming passage.

Figure 1:
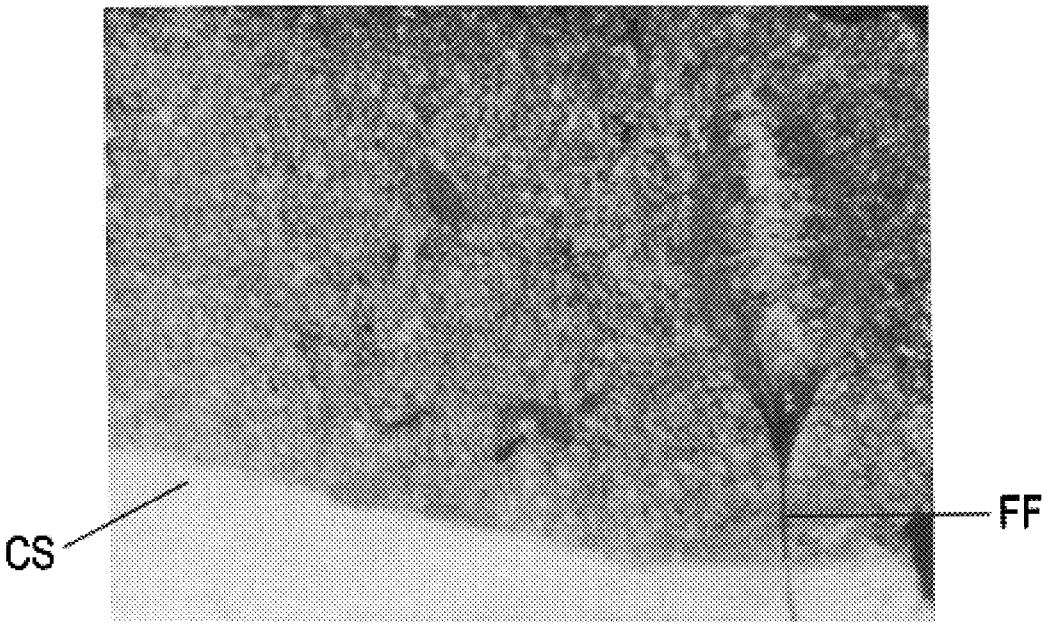
FIG. 1 is a photograph of a fracture surface of an aluminum alloy 319 lost foam cast bar made using the test apparatus of FIG. 3 illustrating a fold defect at the upper (orientation as-cast) fracture surface transverse to a refractory coated pattern core-forming passage taken along the longitudinal axis of the core.

In FIG. 1 taken along the longitudinal axis of a core-forming passage (transverse fracture), the fold defect FF present at the fracture surface of a broken slice of the cast bar can be seen above the lower core surface CS and has resulted from a bubble(s) of vaporized coalesced pattern styrene liquid material at the refractory coated passage having risen upwardly therefrom during casting, leaving a trail or seam of metal which did not bond back together as a result of the aluminum alloy melt temperature being too low at that core-forming passage location.

The locations of the fold defects relative to the polystyrene pattern 16 are represented by short lines designated FF in FIG. 3. It is apparent that the fold defects are formed above and proximate or in the vicinity of the refractory coated core-forming passages 16*a*, 16*b*, 16*c*, 16*d*. The test revealed that 63 mm of the 76 mm of detected fold defects are located in the top half of the cast bar.

During casting, the polystyrene foam pattern is heated by the molten metal such that pattern shrinks and decomposes to form transient pattern decomposition material including styrene liquid material (i.e. polystyrene decomposition liquids) that can coalesce at the refractory coating applied at exterior pattern surfaces and importantly also at the refractory coating applied at the cores-forming passages 16*a*–16*d* in FIG. 3 as the molten aluminum alloy fills the pattern 16 from the bottom up. For example, the expanded polystyrene used as the pattern material in the above example is known to produce styrene when heated in a temperature range of about 200 to about 1000 degrees C., styrene formation peaking at a temperature of about 400 degrees C. Methane, hydrogen, and carbon are produced at temperatures above about 400 degrees C. The coalesced pattern decomposition material including, for example, styrene liquids, can be subsequently vaporized during solidification of the cooling molten aluminum alloy that has displaced the pattern at the core-forming passages and rise as one or more vapor bubbles upwardly into the cooling molten aluminum alloy to form the observed fold defects since the alloy is now cooled sufficiently to be unable to bond back together. The pattern decomposition material coalescing at the exterior refractory coated pattern surfaces are not harmful to the casting as they wick and vaporize into the foundry sand and/or rise up the outside surface of the metal.

The uniformity of adherence or sticking of the thermally insulative, gas permeable refractory coating C to the polymeric pattern has been determined to affect distribution of the coalesced pattern decomposition material. In particular, good refractory coating adherence to the pattern appears to promote localized coalescence of the pattern polymer decomposition material, while regions of poor refractory coating adherence appear to relatively reduce localized coalescence of the pattern polymer material. The adherence of the thermally insulative, gas permeable refractory coating C to the polymeric pattern in turn appears to be affected by initial pattern surface cleanliness. For example, due to manual handling and normal shop lubricants/oils used, some polymer patterns may have randomly distributed surface areas contaminated with lubricant/oil or other foreign matter to which the refractory coating is not well adhered. Pattern polystyrene decomposition material migrates away from these poorly adhered refractory coating areas to other pattern surface areas where the refractory coating C is more well adhered to the pattern. If these pattern surface areas where the refractory coating C is more well adhered are located at areas prone to accumulate relatively large amounts of the pattern polystyrene decomposition liquid materials, such as downwardly facing pattern surfaces in the as-cast orientation, then fold defects appear to be generated in the solidified metal above and/or proximate those pattern surface areas by subsequent vaporization of the coalesced pattern polystyrene decomposition material as the molten metal or alloy advances through the pattern. In such cases, fold defects can be substantially reduced by cleaning or otherwise treating the pattern to achieve more uniform adherence of the refractory coating on the pattern and thus more uniform distribution or accumulation of pattern decomposition material on all surfaces of the refractory coating on the pattern.

In one embodiment of the present invention, the fold defects observed and described above in the cast aluminum alloy 319 bar were essentially eliminated by coating the surfaces of the polystyrene pattern defining the core-forming passages 16*a*, 16*b*, 16*c*, 16*d* with a material or agent that is anti-sticking relative to the aforementioned thermally insulative, gas permeable refractory layer applied as an aqueous slurry. In this embodiment, the refractory layer is not tightly adhered or stuck to the silicone treated pattern surface after the refractory layer is dried and, instead, the anti-sticking material allows the pattern to shrink away from the refractory layer at the selectively coated pattern surface area and decompose without accumulation of pattern decomposition material (e.g. coalesced polymer decomposition liquids) at the refractory layer proximate the pattern surface that can generate fold defects in the casting. The pattern decomposition material can migrate away from silicone treated pattern surface to other pattern surface locations where coalescence is not harmful to the casting. Such pattern surface locations would correspond to the refractory coated exterior vertical and/or upper (orientation as cast) surfaces of the pattern that form outer surfaces of the casting.

In particular, in an illustrative embodiment of the invention, three polystyrene patterns 16 were cleaned in the ultrasonic cleaning bath described below and the cylindrical surfaces of passages 16*a*, 16*b*, 16*c*, 16*d* of the patterns 16 were selectively coated with an anti-wetting agent, such as silicone, by spraying. The silicone source is available commercially under the designation S412 from Stoner Corporation. The silicone coating was less than 0.001 inch in thickness and was applied only to the cylindrical surfaces of passages 16*a*, 16*b*, 16*c*, 16*d* as illustrated in FIG. 3A.

After drying of the silicone coating for ¼ hour, the aforementioned Styro Kote 145.3 refractory coating C was applied to all of exposed pattern surfaces as described above to form a dried refractory coating thickness of approximately 0.012 inch thereon. Each of the three refractory coated patterns and connected pour cup and sprue tubes described above then was embedded in a bed of AFS 55 foundry sand held in the foundry flask in the manner described above. Aluminum alloy 319 was air melted in a conventional clay graphite refractory crucible (not shown) and dipped out of the crucible using a ladle at a melt temperature of 1200 degrees F. so that a pour temperature of about 1150 degrees F. was provided. About 5 pounds of the aluminum alloy 319 was poured into the pour cup 10 and gravity pushed or fed upwardly into the polystyrene bar or rod pattern 16 to vaporize and displace the polystyrene pattern 16 in the foundry sand 20 from the bottom up to produce a cast aluminum alloy bar having a diameter of 1.5 inches. The molten aluminum alloy charge was solidified in the foundry sand bed over a time period of ½ hour in air.

The resulting three cast bars thereby made in accordance with one embodiment of the present invention were examined using the same x-ray and fracture examination procedures described above to determine gas hole defects and fold counts.

In TABLE I, these results are set forth to the right of the core type designated "lost foam cores silicone treated" for the three (3) cast bars made in the manner described above pursuant to one embodiment of the invention. The results indicate that there were zero x-ray counts and zero millimeter of fold defect length in the first and third cast bars made pursuant to the invention. There was one x-ray count representative of a gas hole defect and zero millimeter of fold defect length for the second cast bar made pursuant to the invention. Thus, the present invention eliminated fold defects in the three aluminum alloy 319 cast bars and essentially eliminated gas hole defects. The results of TABLE I represent a significant improvement over the quality of the comparison cast bar designated "lost foam" in TABLE I formed in the manner representative of prior art lost foam techniques.

Another embodiment of the present invention involves treating the polymeric pattern in a different manner to substantially reduce or eliminate fold defects. This embodiment recognizes that pattern polymer decomposition material will not coalesce to harmful levels at clean uncoated pattern surface regions (e.g. at uncoated polystyrene surfaces) backed or contacted directly by the dry, loose foundry sand bed or mass 20 as compared to pattern regions coated with the aforementioned thermally insulative, gas permeable refractory coating C. The pattern decomposition material generated during pattern destruction does not accumulate at the dry, loose foundry sand which contacts the pattern surface but is not adhered thereto. Since omission of the thermally insulative, gas permeable refractory coating C may cause the foundry sand bed to lose shape there during casting as the molten metal progressively decomposes the pattern, this embodiment of the invention may be used only where some loss of casting shape would not be a problem. Downwardly facing surfaces (as cast orientation) of the pattern are generally amenable to omission of the refractory coating. For example, there is only minor loss of cast shape in the downwardly facing rectangular fold defect prone area on the automotive cylinder head shown in FIGS. 6, 7, and 9 discussed below.

Figure 4:
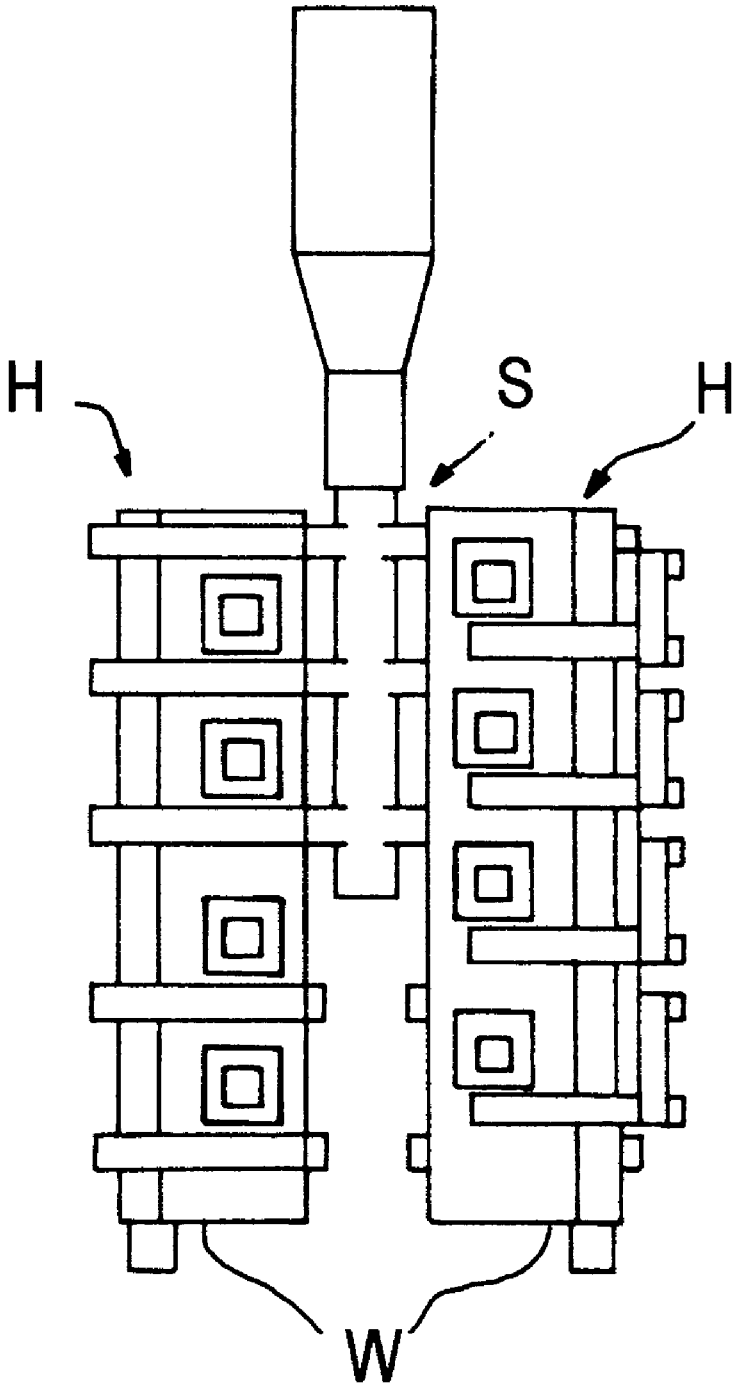
FIG. 4 is a perspective view of polystyrene pattern assembly for casting automotive cylinder heads.
Figure 5:
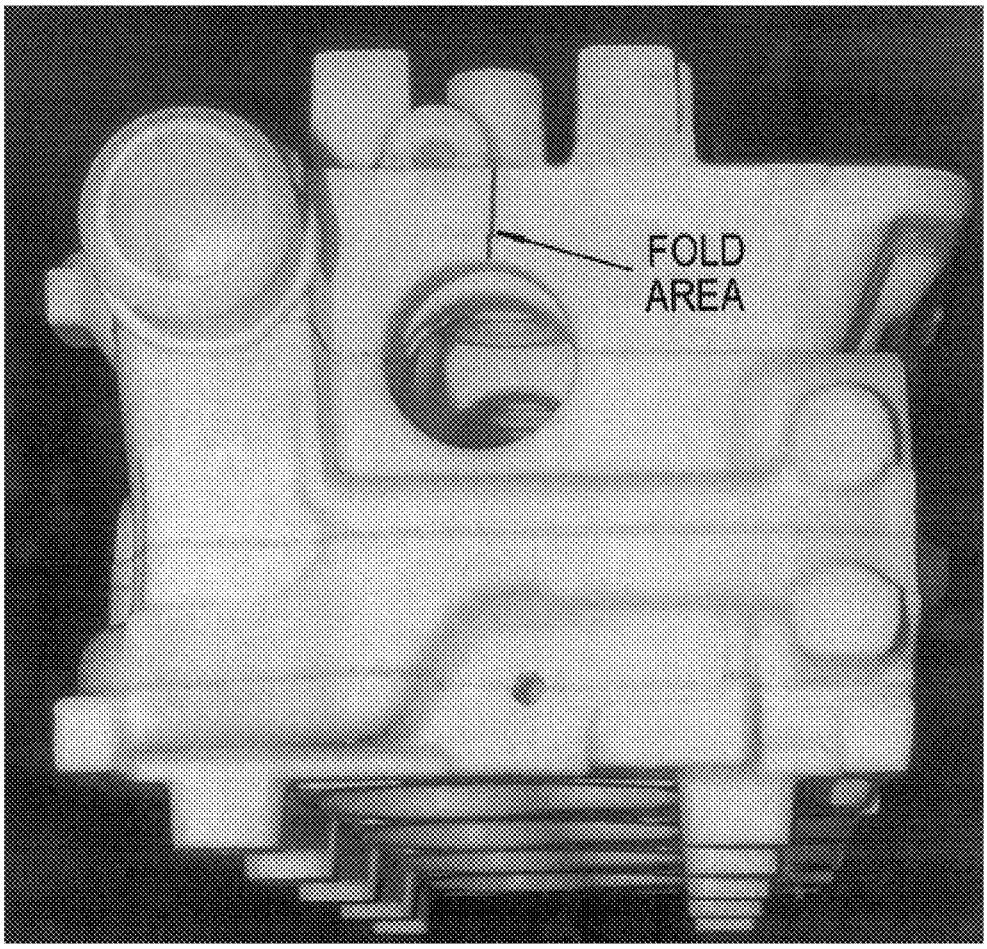
FIG. 5 is a photograph of an automotive cylinder head casting pattern showing a fold defect prone area of the casting.

Embodiments of the invention are illustrated by means of lost foam casting tests of an aluminum alloy automobile cylinder head. A polystyrene pattern assembly comprising two Saturn automotive cylinder heads H connected to a common sprue arrangement S is shown in FIG. 4. Two cylinder heads are cast with one central sprue arrangement. The center of a particular downwardly facing surface area of the cylinder head casting prone to suffer from formation of fold defects is indicated by the arrow and line in FIG. 5. For example, fold defects typically have been seen visually in the lowermost (orientation as cast) bottom wall W of the cylinder head, FIG. 4, near the outermost side of the hole surface, FIGS. 5 and 6, when the fold defects are numerous. Quality of the cast cylinder heads typically has been variable with some good cast heads and some bad cast heads with visual fold defects. To illustrate practice of the present invention, two polystyrene pattern assemblies were prepared each with two cylinder head assemblies H arranged about a common sprue S; e.g. see FIG. 4. The four cylinder head polystyrene patterns were treated differently as shown in FIGS. 6–9. The cylinder head pattern assembly used to make the casting of FIG. 6 was not treated in accordance with the invention and was used in the as-received condition.

On the other hand, the cylinder head pattern used to make the casting of FIG. 7 was cleaned with soap and water at the delineated area (defined by rectangular lines) as described below pursuant to an embodiment of the invention. The cylinder head pattern assembly used to make the casting of FIG. 8 was cleaned and sprayed with silicone at the delineated area (defined by rectangular lines) as described below pursuant to another embodiment of the invention. The cylinder head pattern assembly used to make the casting of FIG. 9 was ultrasonically cleaned and left uncoated with a refractory layer at the delineated area (defined by rectangular lines) as described below pursuant to still another embodiment of the invention.

Figure 7:
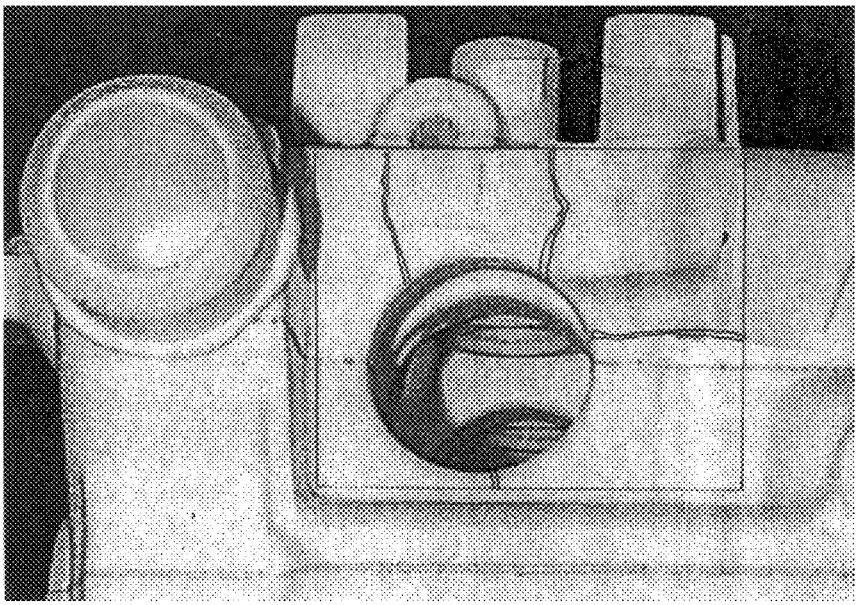
FIG. 7 is a photograph illustrating that no fold defects were found in fractured automotive cylinder head castings made using pattern assemblies cleaned pursuant to an embodiment of the invention.

In particular, the detergent employed to clean the cylinder head pattern used to make the casting of FIG. 7 was commercially available DAWN dish washing soap at about 0.5% volume soap in tap water. The defect prone lowermost, downwardly facing surface of the pattern was cleaned by the detergent by brushing and is delineated by rectangular lines drawn on FIG. 7. Also similarly cleaned was an interior, upwardly facing pattern surface located above the lowermost pattern surface on an opposite (upper) side of a bottom pattern wall defined by the lateral passage visible in FIG. 7.

Figure 9:
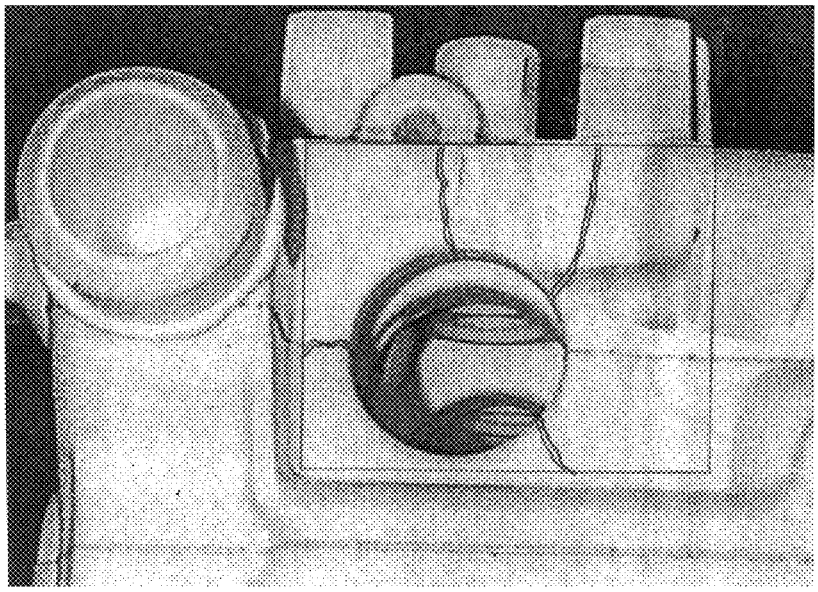
FIG. 9 is a photograph illustrating that no fold defects were found in fractured automotive cylinder head castings made using a pattern assembly ultrasonically cleaned and free of thermal insulative refractory coating pursuant to still another embodiment of the invention.

The ultrasonic cleaning bath employed to clean the cylinder head pattern used to make the casting of FIG. 9 comprised 0.5% Victawet surfactant in tap water. The pattern was immersed and vibrated in the detergent solution to clean it.

Figure 8:
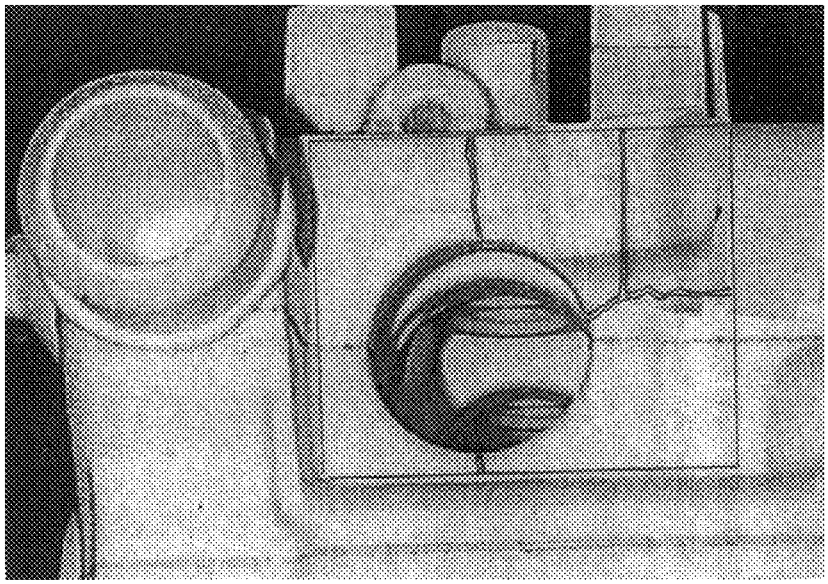
FIG. 8 is a photograph illustrating that no fold defects were found in fractured automotive cylinder head castings made using pattern assemblies cleaned and silicone sprayed pursuant to another embodiment of the invention.

The cylinder head pattern assembly used to make the casting of FIG. 8 was silicone treated (manually sprayed with Stoner S412 silicone die lubricant spray can to provide thin layer of about 0.0005 inch of silicone) at the fold prone surface area delineated by the rectangular lines drawn on FIG. 8 before coating with Borden 143.5 Styrokote refractory coating to a thickness of about 0.012 inch.

The cylinder head pattern assembly used to make the casting of FIG. 9 was left uncoated with Styrokote refractory coating at the fold prone surface area delineated by the rectangular lines drawn on FIG. 9 while all other pattern surface areas were coated with Borden 143.5 Styrokote refractory coating C to a thickness of about 0.012 inch.

The fully or partially refractory coated pattern assemblies were dried for two days under ambient conditions, invested with AFS-45 sand in a steel flask and cast with aluminum alloy 319 at 1425 degrees F., which corresponds to normal casting practice for this alloy. The castings remained in the sand for two hours, were shaken out, and then evaluated visually and by fracturing for fold defects.

Figure 6:
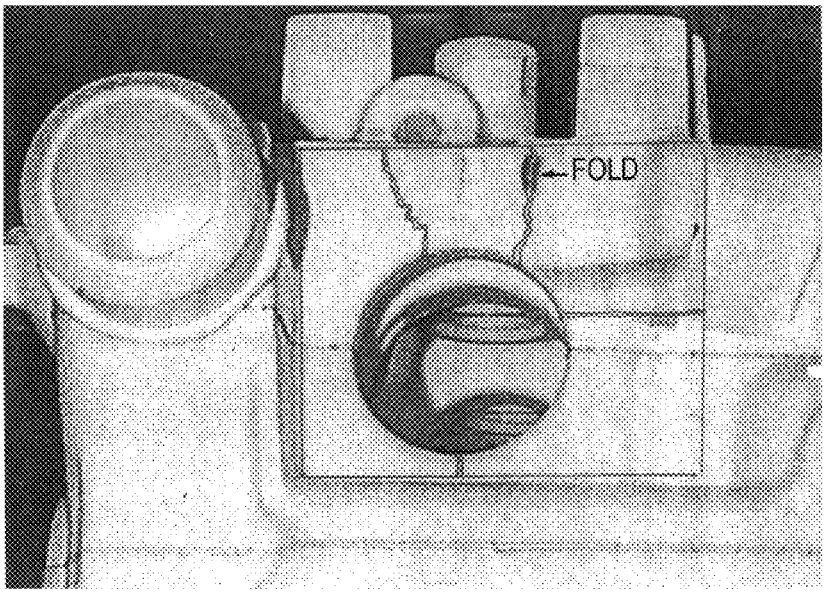
FIG. 6 is a photograph illustrating location of fold defects in fractured automotive cylinder head castings made using untreated pattern assemblies.

No fold defects were seen visually on any of the cast cylinder heads, but one defect designated as "fold" in FIG. 6 was found in the cast cylinder head made with the as-received, untreated pattern by fracturing the casting. The fold defect was ¼ inch width by ¼ inch length spaced from the top surface relative to FIG. 6 extending down into the fold prone area delineated by rectangular lines drawn on FIG. 6. The closely spaced, irregular double lines shown radiating from the hole in FIG. 6 (also in FIGS. 7–9) show the fracture paths. Fracturing of the castings was conducted by supporting the right and left sides of the cut out section (approximated by the rectangular lines drawn in FIGS. 6–9) and bending with an arbor press in the middle of the cut out. Additional fractures were made similarly so that the stress would find planes of weakness (i.e. fold defects). Only the casting produced from the untreated pattern assembly had an internal fold defect, FIG. 6. FIGS. 7, 8 and 9 illustrate the absence of fold defects in the fractured areas of cylinder heads made pursuant to embodiments of the invention.

The lack of fold defects in the casting made using the cleaned pattern, FIG. 7, was attributable to removal of localized foreign matter on the pattern that could have caused excessive accumulation of pattern decomposition material at the refractory layer proximate the defect prone pattern surface area.

The results of additional tests involving lost foam casting of Saturn automobile aluminum alloy cylinder heads are shown ranked for severity of fold defects in Table II. In Table II, the "untreated parts" (cylinder heads) were cast using as-received polystyrene pattern assemblies without any treatment.

The "treated parts" (cylinder heads) were sprayed with silicone spray described above on bottom surface areas corresponding to the areas delineated by rectangular lines drawn on FIGS. 6–9 (approximately 3 inches by 4 inches) heretofore known to be prone to exhibit fold defects in the cast cylinder head.

The fold defect prone surface areas were manually sprayed with silicone (aforementioned Stoner S412 silicone die lubricant) from a spray can prior to coating with the aforementioned Borden 143.5 Styrokote refractory coating.

The cast parts then were examined for fold defects and ranked by number evaluations which are indicative of square millimeters of surface area of fold defects found in fracturing the castings in the fold defect prone surface area. The part numbers in Table II are arbitrary numbers assigned to the test castings.

TABLE II

| Rank order sort of parts | | | |
|---|---|---|---|
| Untreated Parts | | Treated Parts | |
| CB4 | 0 | BA1 | 0 |
| CB10 | 0 | BA2 | 0 |
| CB15 | 0 | BA3 | 0 |
| CA10 | 7 | BA4 | 0 |
| CA1 | 12 | BA5 | 0 |
| CB13 | 12 | BA6 | 0 |
| CA11 | 15 | BA7 | 0 |
| CA12 | 18 | BA8 | 0 |
| CA8 | 20 | BA9 | 0 |
| CB14 | 25 | BA11 | 0 |
| CA13 | 27 | BA12 | 0 |
| CB7 | 35 | BA13 | 0 |
| CB12 | 35 | BA15 | 0 |
| CB18 | 35 | BA16 | 0 |
| CB20 | 35 | BA17 | 0 |
| CA15 | 40 | BA18 | 0 |
| CB8 | 40 | BA19 | 0 |
| CB11 | 40 | BB1 | 0 |
| CB17 | 42 | BB2 | 0 |
| CB1 | 45 | BB3 | 0 |
| CB16 | 48 | BB4 | 0 |
| CA7 | 50 | BB5 | 0 |
| CA9 | 50 | BB6 | 0 |
| CB6 | 50 | BB7 | 0 |
| CA6 | 60 | BB8 | 0 |
| CA20 | 60 | BB9 | 0 |
| CB9 | 60 | BB11 | 0 |
| CA3 | 70 | BB13 | 0 |
| CB2 | 72 | BB14 | 0 |
| CA14 | 80 | BB15 | 0 |
| CA18 | 80 | BB16 | 0 |
| CA17 | 84 | BB17 | 0 |
| CB3 | 85 | BB18 | 0 |
| CA4 | 90 | BB19 | 0 |
| CB5 | 90 | BB20 | 0 |
| CB19 | 90 | BB12 | 1 |
| CA2 | 100 | BA10 | 4 |
| CA5 | 100 | BA20 | 6 |
| CA16 | 100 | BB10 | 6 |
| CA19 | 100 | BA14 | 21 |

It is apparent that silicone spray treatment of the downwardly facing fold defect prone surface areas of the pattern assemblies pursuant to the invention significantly reduced the number of cast cylinder heads exhibiting fold defects. In total, the area of fold defects of castings made in accordance with the invention was less than 1.9% of the fold defect area of castings made with as-received patterns without any treatment. It is thought that the observed fold defects in "treated parts" BB12, BA20, BB10, and BA14 were due to variations in silicone spraying that occurred during the manual spraying operation.

The present invention not only substantially reduces or eliminates fold defects in cored lost foam castings but also permits lower melt casting temperatures to be used with concomitant improvements in casting microstructure (e.g. finer dendritic arm spacing) and mechanical properties.

While the invention has been described in terms of specific embodiments thereof, it is not intended to be limited thereto but rather only to the extent set forth in the following claims.

What is claimed is:

1. In a method of casting wherein a destructible pattern of an article to be cast is coated with a gas permeable refractory layer and disposed in refractory material for contact with molten metal or alloy that destroys said pattern and replaces said pattern in said refractory material to form a cast article, the improvement comprising, prior to providing said refractory layer on said pattern, selectively coating a surface of said pattern proximate to which surface a fold defect comprising an unbonded seam defect is prone to form in said cast article with an anti-sticking material that reduces adhesion between said refractory layer and said surface so as to reduce or eliminate formation of said fold defect in the cast article proximate said surface.

2. The method of claim 1 wherein said material comprises silicone.

3. The method of claim 1 wherein the pattern comprises a polymeric material.

4. The method of claim 1 further including cleaning said surface with a cleaning agent prior to selectively coating said surface.

5. The method of claim 1 wherein said surface comprises a downwardly-facing surface of said pattern.

6. The method of claim 1 wherein molten aluminum or aluminum alloy is contacted with said pattern disposed in said refractory material.

7. A destructible pattern for casting molten metal that destroys and replaces said pattern during casting, said pattern having a silicone coating on a surface of said pattern proximate to which surface a fold defect comprising an unbonded seam defect is prone to form in said metal, and a thermally insulative, gas permeable refractory layer overlying said coating.

* * * * *